United States Patent [19]

Kan et al.

[11] Patent Number: 4,559,899

[45] Date of Patent: Dec. 24, 1985

[54] THIN DEVELOPER LAYER FORMING DEVICE

[75] Inventors: Fumitaka Kan, Yokohama; Hidemi Egami, Zama; Atsushi Hosoi, Tokyo; Hatsuo Tajima, Matsudo; Shunji Nakamura; Kimio Nakahata, both of Kawasaki, all of Japan

[73] Assignee: Canon Kabushiki Kaisha, Tokyo, Japan

[21] Appl. No.: 630,411

[22] Filed: Jul. 13, 1984

[30] Foreign Application Priority Data

Jul. 19, 1983 [JP] Japan ..... 58-130340

[51] Int. Cl.[4] ..... G03G 15/09

[52] U.S. Cl. ..... 118/657; 355/3 DD

[58] Field of Search ..... 427/657; 355/3 DD

[56] References Cited

U.S. PATENT DOCUMENTS 4,244,322 1/1981 Nomura et al. ..... 118/658

4,406,535 9/1983 Sakamoto et al. ..... 355/3

4,457,257 7/1984 Murakami et al. ..... 118/652

*Primary Examiner*—Bernard D. Pianalto

*Attorney, Agent, or Firm*—Fitzpatrick, Cella, Harper & Scinto

[57] ABSTRACT

A thin developer layer forming device includes a developer supply container, having an opening, for containing a non-magnetic developer and magnetic particles, an endlessly movable developer carrying member of a non-magnetic material for carrying a developer, which is movable between an inside of the developer supply container and an outside of the developer supply container through the opening, rotatable member for generating a magnetic field, disposed in the carrying member, and a magnetic particles confining member, provided outside of the developer carrying member and cooperable with a magnetic pole of the magnetic field generating means to confine the magnetic particles within the developer container, wherein the magnetic field generating member is rotated in the developer carrier to move the magnetic particles in a direction opposite to a direction of movement of the developer carrying member.

8 Claims, 3 Drawing Figures

F I G. I

THIN DEVELOPER LAYER FORMING DEVICE

BACKGROUND OF THE INVENTION

The present invention relates to a device for forming a thin layer of dry developer to be used with a developing apparatus, more particularly to such a device of the type using a non-magnetic developer.

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent device for the improved sharpness, resolution or the other qualities has necessiated the achievement of the system for forming a thin layer of one-component dry developer.

A method of forming a thin layer of one-component dry developer has been proposed in U.S. Pat. Nos. 4386577 and 4387664 and this has been put into practice. However, this is the formation of a thin layer of a magnetic developer, not of a non-magnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material, which is usually black, contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer. In the case where the textile brush is used with a resilient material blade, it would be possible to regulate the amount of the developer applied, but the applied toner layer is not uniform in thickness. Moreover, the blade only rubs the brush so that the developer particles are not charged, resulting in foggy images.

SUMMARY OF THE INVENTION

Accordingly it is an object of the present invention to provide a device which is substantially free from the drawbacks of the conventional devices and by which a thin layer of a developer of uniform thickness is formed on a developer carrying member with a sufficient triboelectric charge.

It is another object of the present invention to provide a novel and useful device for forming a thin layer of a non-magnetic developer.

According to an embodiment of the present invention there is provided a thin developer layer forming device, comprising a developer supply container, having an opening, for containing a non-magnetic developer and magnetic particles; an endlessly movable developer carrying member of a non-magnetic material for carrying a developer, which is movable between an inside of the developer supply container and an outside of the developer supply container through the opening; a rotatable device for generating a magnetic field, disposed in the carrying member; and a magnetic particle confining member, provided outside of the developer carrying member and cooperable with a magnetic pole of the magnetic field generating device to confine the magnetic particles within the developer container; wherein the magnetic field generating device is rotated in the developer carrier to move the magnetic particles in a direction opposite to a direction of movement of the developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiment of the present invention will be described in detail in conjunction with the accompanying drawings.

Figure 1:
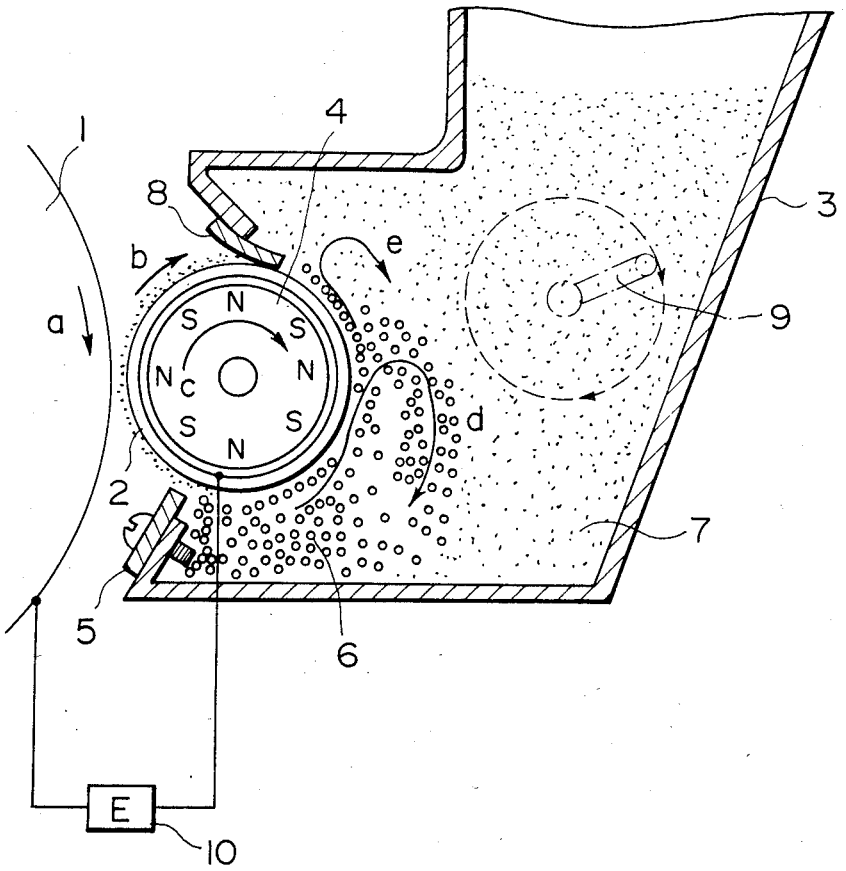
FIG. 1 is a cross-sectional view of a developer thin layer forming device according to an embodiment of the present invention.

FIG. 1 illustrates a developer thin layer forming device, wherein a photosensitive member 1 rotates in the direction of arrow a. Opposed to the surface of the photosensitive member 1 with a gap, a non-magnetic member 2 for carrying a developer is provided. In this embodiment, the developer carrying member 2 is in the form of a cylinder, or more particularly, a sleeve, but it may be an endlessly movable web, as with photosensitive member 1. With the rotation of the photosensitive member 1, the carrying member 2 is rotated in the direction of arrow b. A developer supply container 3 is provided to supply the developer to the carrying member 2. The container 3 is provided with an opening adjacent its lower part. The carrying member 2 is provided in the opening. Since the carrying member 2 is partly exposed outside, the surface thereof moves from the inside of the container 3 to the outside thereof and then back into the container 3. Within the developer carrying member 2, there is magnetic field generating means for generating a magnetic field, i.e., a magnet 4 in this embodiment, which is rotatable in the direction of arrow c. The magnet 4 is in the form of a roller provided with plural magnetic poles. Adjacent to the lower part of the opening of the developer container 3, there is provided a magnetic blade 5 (magnetic particle confining member) which is of a magnetic material.

Into the container 3 of the above-described structure, magnetic particles or a mixture of magnetic particles and non-magnetic developer particles are supplied so that a base layer 6 is formed. When only the magnetic particles are supplied, the base layer 6 will become a mixture by the subsequent supply of the non-magnetic developer. The mixture constituting the base layer 6 preferably contains 5–70 wt. % of non-magnetic developer, but may only have magnetic particles. The particle diameter of the magnetic particle is 30–200, preferably 70–150 microns. Each of the magnetic particles may consist of a magnetic material or may consist of a magnetic material and non-magnetic material. The magnetic particles in the base layer 16 are formed into a magnetic brush by the magnetic field provided by the magnet 4, which brush is effective to perform a circulation which will be described in detail hereinafter.

Above the base layer 6, non-magnetic developer particles are supplied to form a developer layer 7, so that two layers are formed, that is, the base layer 6 on the outside of the carrying member 2 and the developer layer 7 further outside thereof. The non-magnetic developer supplied may contain a small amount of magnetic particles, but even in that case, the magnetic particle content of the developer layer 7 is smaller than that of the base layer 6. To the non-magnetic developer particles, silica particles for enhancing the flowability and/or abrasive particles for effectively abrading the surface of the photosensitive member 1 may be added. The formation of the two layers is not limited to this manner, i.e., two materials are supplied separately, but may be made, for example, by supplying a uniform mixture of the magnetic particles and non-magnetic developer containing a sufficient amount of respective materials for the entire base layer 6 and developer layer 7, and then vibrating the container 3 to form the two layers, using the magnetic field of the magnet 4 and the difference in the specific gravity between the two materials.

In this state, the magnetic particles are influenced by the gravity force and by the magnetic force produced by the magnetic field generating means 4 and exist adjacent to the surface of the developer carrying member 2 and adjacent to the bottom of the developer container 3.

When the carrying member 2 and the magnetic field generating means 4 are rotated in the directions shown by arrows b and c, and at the speeds N r.p.m. and n r.p.m., respectively, the magnetic particles constituting the magnetic brush move in the direction opposite to the direction b at the speed V which is expressed, according to a known analysis (Harada et al, Journal of Japanese Association of Applied Magnetic, Vol. No. 4 (1980), p. 136), by the following:

$$V = n\pi DhP/60(\pi D\text{-}hP) - N\pi^2 D^2/60(\pi D\text{-}hP)$$

where D is a diameter of the developer carrying member 2; P, the number of magnetic poles; and h, the height of the magnetic brush.

In order that the magnetic particles are kept in the developer container 3, it is required to satisfy $V>0$, that is, $$(n/N) > (\pi D/hP) > 1$$

When this is satisfied, the magnetic particles constituting the magnetic brush go upwardly from the bottom of the developer container 3, and some parts of them separate from the carrying member because of the gravity to circulate, as shown by arrow d, and the rest are further conveyed up with the rotation of the carrying member 1 and then scraped off by a scaling member 8 which will be described hereinafter. The scraped particles move downwardly under the force of gravity, thus circulating in the container 3.

As described above, in the area adjacent to the surface of the carrying member 2, the magnetic particles at the bottom of the container move upwardly along the outer peripheral of the carrying member 2 by the cooperation of the rotation of the magnetic field caused by the rotating magnet 4 and the rotation of the carrying member 2.

The magnetic particles are moved upwardly by the rotation of the carrying member 2, but are scraped off by a sealing member 8. The magnetic particles behind the sealing member 8 within the container 3 are urged by the magnetic particles fed continuously from the bottom of the container 3, and turn, as shown by an arrow e in FIG. 1, whereafter they slowly move down under the force of gravity. During this downward movement, the magnetic particles take the non-magnetic developer particles among themselves from the lower part of the developer layer 7. Then, the magnetic particles return to the bottom part of the container 3, and those actions are repeated. Some parts of the magnetic particles are turned earlier as shown in an arrow d by the force of gravity.

The magnetic particles existing at the lower portion of the container 3 are confined by the magnetic field formed between the confining member 5 and the magnetic field generating means 4. In addition, those magnetic particles are influenced by the conveying force in the direction d opposite to the direction c of the magnetic field generating means 4, so that they are further prevented from going out of the developer container 5 through the clearance between the tip of the confining member 5 and the surface of the carrying member 2.

On the other hand, the triboelectrically charged developer particles, which are non-magnetic, are not limited by the magnetic field existing in the clearance between the tip of the confining member 5 and the surface of the carrying member 2, so that they are allowed to pass therethrough, and they are applied as a thin layer of uniform thickness on the carrying member 2. The thin layer of the non-magnetic developer is thus conveyed out of the container 3, and moved to the developing station, where the thin layer is opposed to the photosensitive member 1 to develop a latent image thereon. The developer not transferred to the photosensitive member 1 passes under the sealing member 8 and returns into the container 3. The sealing member 8 has to have the dual functions of allowing and preventing the passage of the magnetic particles. To meet this, it is preferable that a sheet of a flexible material, such as polyethyleneterephthalate, is curled, and untinode side thereof is lightly contacted to the surface of the developer carrying member 2 with the free end edge thereof spaced from the surface by several microns to several tens microns. Also, in order to satisfy the requirement, it is preferable that the sealing member 8 is inclined co-directional with the movement of the carrying member 2 and contacted thereto, as shown in FIG. 1.

The developer container of FIG. 1 is shown as having a stirring member 9. This is not essential, but it is preferable in that it can prevent possible coagulation of the developer.

In this embodiment of the present invention, the non-magnetic developer is triboelectrically charged by the contact with the magnetic particles and with the carrying member 2. Preferably, however, the triboelectric charge with the magnetic particles is reduced by treating the surface of the magnetic particle with an insulating material, such as oxide coating and a resin having the same electrostatic level as the non-magnetic developer, so that the necessary charging is effected by the contact with the carrying member 2 surface. Then, the deterioration of the magnetic particles is prevented, and simultaneously, the non-magnetic developer is stably coated on the carrying member 2.

The above-described formation of the two layers is not inevitable. Uniform mixture of the non-magnetic developer and the magnetic particles is satisfactory if the sufficient amount of the magnetic particles to form a sufficient magnetic brush. However, for the purpose of a long term stability of the magnetic brush formation, the two layer structure is preferable.

The developing system to be used here is preferably the non-contact type development disclosed in U.S. Pat. No. 4395476, although conventional contact type development is usable. Between the photosensitive member 1 and the carrying member 2, a voltage is applied by a bias voltage source 10 which is of AC, DC or preferably an AC superposed with a DC.

The developer to be consumed for the development is supplied from the base layer 6, and the consumption of the developer in the base layer 6 is compensated from the developer layer 7 during the above-described circulation. Since the base layer 6 is formed around the carrying member 2 from the beginning, and since the developer layer 7 does not contain the magnetic particles, or if any, it contains only a small amount to compensate the unavoidably lost magnetic particles, the state of the magnetic brush formed in the base layer 6 is maintained constant over a long run of the device. In this sense, the magnetic particles within the base layer 6 is a part of the developing or thin layer forming apparatus, rather than a developer or a part of a developer.

It is preferable that the carrying member 2 contacts only the base layer 6 and does not directly contact the developer layer 7, since then the conveying force by the carrying member 2 does not influence the developer layer 7 so that the content of the developer in the base layer 6 does not change irrespective of the amount of the non-magnetic particles in the developer layer 7.

A detailed example of the above embodiment of the present invention will be described.

A carrying member 2 in the form of a stainless steel (SUS 304) cylinder having an outer diameter of 32 mm was used. The surface of the cylinder was treated by irregular sand-blasting of ALUNDUM abrasive particles No. 600 to provide the surface roughness, in the circumferential direction, of 1 micron (RZ=20). It was not preferable that the surface roughness was higher than RZ=20 microns, since the magnetic particles were conveyed to the developing station together with the developer, although the amount was quite small. As for the sealing member 8, a Mylar sheet of 75 microns thickness was used.

Within the carrying member 2, a magnet 4 of ferrite sintering type was disposed and rotated in the direction of the arrow c. The magnet 4 had 8 equidistant poles. The magnetic flux density of each of the poles was 800 gauss.

The tip of the confining member 5 was spaced apart by 200 microns from the surface of the carrying member 2.

As for the magnetic particles, spherical ferrite of particle size 61–104 microns and having a max. magnetization of 62 em u/g (Tokyo Denki Kagaku Kogyo Kabushiki Kaisha, Japan), was used. For the non-magnetic developer; a negative developer powder having 100 parts of polyester resin incorporating 3 parts of copper phthalocyanine pigment and 5 parts of negative charge controlling agent (alkylsalicylic acid metal complex) 0.6% silica added, was used. The average particle size thereof was 12 microns.

The thin coating of the non-magnetic developer obtained by the above structure was opposed to a photosensitive member bearing an electrostatic latent image of +500 V at the dark area and −50 V at the light area with the clearance of 300 microns to the surface of the photosensitive member 1. The bias voltage of 800 Hz and peak-to-peak voltage of 1.8 KV with the central value of +100 V was applied by the source 10. Good resultant images without ghost or fog were obtained.

Figure 2:
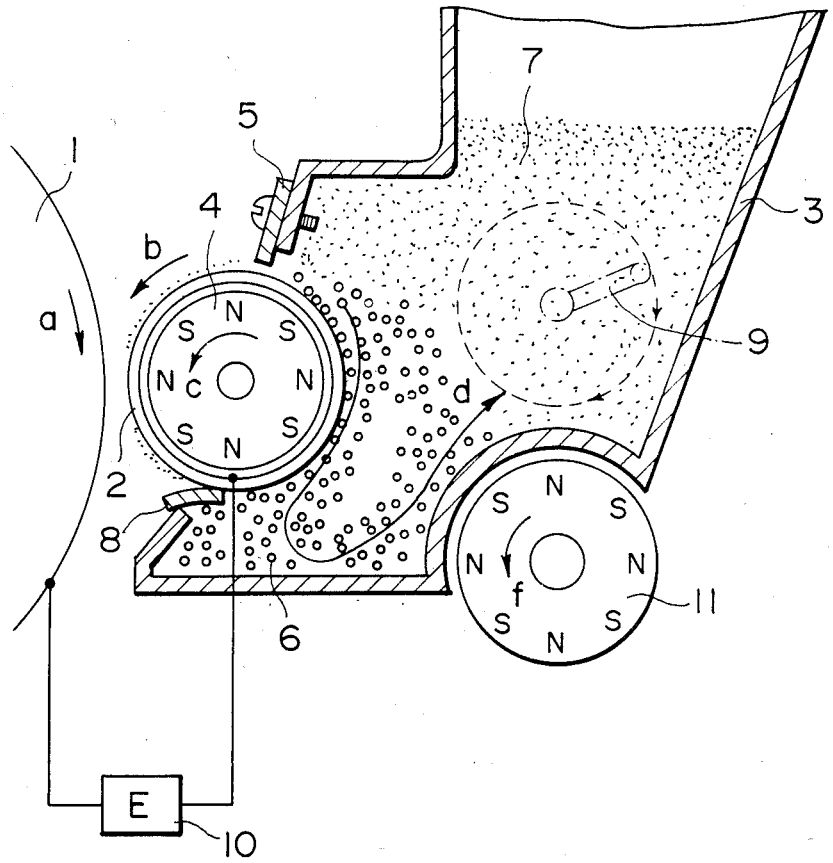
FIG. 2 is a cross-sectional view of a developer thin layer forming device according to another embodiment of the present invention.

FIG. 2 shows another embodiment of the present invention.

Since this embodiment is similar to the foregoing embodiment, except for the portions which will be described, the detailed description of the similar parts is omitted for the sake of simplicity by assigning the same reference numerals to the elements having the corresponding functions.

In this embodiment, the developer carrying member 2 rotates so that its surface moves codirectionally with the surface of the photosensitive member 1 which rotates in the direction shown by arrow b. The magnet 4 is rotated in the direction of an arrow c and at a higher rotational speed than the developer carrying member 2 so that the following is satisfied:

$$(n/N) > (\pi D/hP)$$

where n is a rotational speed of the magnet 4; N, a rotational speed of the developer carrying member 2; D, a diameter of the carrying member 2; P, the number of the magnetic poles of the magnet 4; and h, a height of the magnetic brush.

By doing so, the magnetic brush moves opposite to the developer carrying member. That is, they are moved from the bottom of the container 3 by the magnetic field provided by the multi-pole magnet 11 which rotates in the direction of an arrow f, and they are returned to the surface of the carrier by the stirring member 4.

The non-magnetic developer particles, which are triboelectrically charged by the friction with the carrying member 2, are moved in the same direction (b) and at the same speed as the carrying member 2. This embodiment, which is remarkably different from the FIG. 1 embodiment in the relative speed between the carrying member 2 and the photosensitive member 1, has provided the same quality of developed images.

Figure 3:
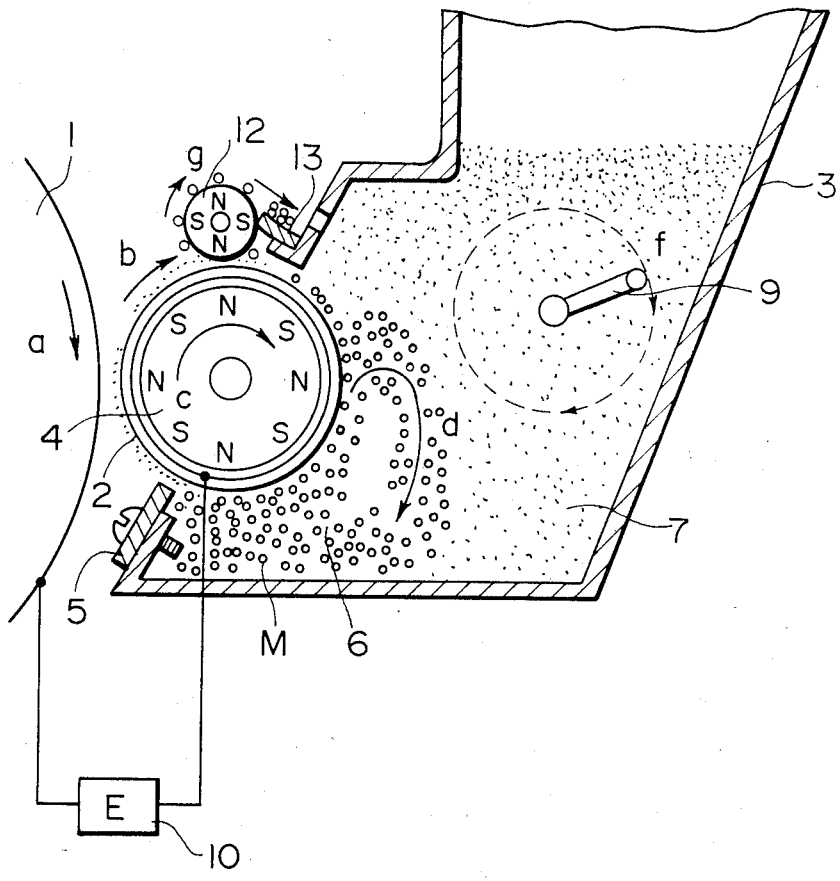
FIG. 3 is a cross-sectional view of a developer thin layer forming device according to a further embodiment of the present invention.

FIG. 3 shows a further embodiment, wherein, in place of the sealing member 8 of FIG. 1, sealing means which employs a rotatable multi-pole magnet 12 and which is out of contact with the carrying member surface unlike the FIG. 1 embodiment. The magnetic particles which move in the direction opposite to the carrying member 2 are trapped or caught by the magnet 12, which moves in the direction of an arrow g, and they are scraped off from the surface of the magnet 12 by a scraper blade 13, thus returning into the developer container 3. The sealing mechanism is more complicated than that shown in FIG. 1, but correspondingly provides a better or more complete sealing function. Additionally, since it is not contacted to the surface of the developer carrying member 2, there is no possibility of damaging the carrying member surface. It is a possible alternative that the magnet 12 is enclosed with a rotatable sleeve which rotates relative to the magnet 12, so that the magnetic particles are caught and carried back on the sleeve.

In the foregoing embodiments, the confining member has been described as being a magnetic blade, but it may be a non-magnetic blade.

As described above, according to the present invention, a uniform and thin layer of a non-magnetic developer can be stably provided to improve a developing operation.

While the invention has been described with reference to the structures disclosed herein, it is not confined to the details set forth and this application is intended to cover such modifications or changes as may come within the purpose of the improvements or the scope of the following claims.

What is claimed is:

1. A thin developer layer forming device, comprising:

a developer supply container, having an opening, for containing a non-magnetic developer and magnetic particles;

an endlessly movable developer carrying member for carrying the developer and movable between the inside of said developer supply container and the outside of said developer supply container through the opening;

means for moving said developer carrying member in a direction to convey the non-magnetic developer to a developing area;

magnetic field generating means, disposed in said carrying member, for generating a magnetic field, wherein the magnetic particles are carried on the surface of said carrying member by said magnetic field, and are circulatable in said developer supply container;

a magnetic particle confining member provided at a position where the developer discharges out of said container, said confining member being effective to regulate the amount of developer discharged as a thin layer from said container and being cooperable with a magnetic pole of said magnetic field generating means to prevent the magnetic particles from leaking from said container;

sealing means provided at a position where the developer on said carrying member returns, after developing action at the developing area, into said container, said sealing means being effective to allow the developer to return into said container while preventing the magnetic particles from leaking out thereof; and means for rotating said magnetic field generating means in the same direction as said developer carrying member so as to move the magnetic particles in a direction opposite to the movement direction of said developer carrying member;

whereby substantially only non-magnetic developer is withdrawn from said container for development.

2. A device according to claim 1, wherein the following is satisfied, $$(n/N) > (\pi D/hP) > 1$$

where N is a rotational speed (r.p.m.) of said developer carrying member; n is a rotational speed (r.p.m.) of said magnetic field generating means; D is a diameter of said carrying member; P is the number of the magnetic poles of said magnetic field generating means; and h is a height of a magnetic brush formed on the magnetic particles.

3. A device according to claim 1, wherein said sealing member is in the form of a sheet which is inclined codirectionally with movement of the carrying member to allow passage of the developer carried on the carrying member but to prevent passage of the developer coming thereto in the opposite direction.

4. A device according to claim 1, wherein said sealing member is a magnetic member which is out of contact with the surface of the carrying member to catch the magnetic particles.

5. A device according to claim 1, further comprising a stirring member in said container.

6. A device according to claim 1, further comprising a rotatable magnet outside said container to circulate the magnetic particles in said container.

7. A device according to claim 1, wherein said carrying member has its surface roughness not more than $R_Z = 20\ \mu m$.

8. A thin developer layer forming device, comprising:

a developer supply container, having an opening, for containing a non-magnetic developer and magnetic particles;

a rotatable non-magnetic sleeve, provided in the opening, for carrying the non-magnetic developer in a direction the same as the direction of its rotation;

means for rotating said sleeve in a direction to convey the non-magnetic developer to a developing area;

a magnet roller provided in said sleeve, wherein the magnetic particles are carried on the surface of said sleeve by said magnetic field and are circulatable in said container;

a magnetic particle confining blade provided at a position where the developer discharges out of said container, said blade being effective to regulate the amount of the developer discharged as a thin layer from said container and being cooperable with a magnetic pole of said magnet roller to prevent the magnetic particles from leaking from said container;

sealing means provided at a position where the developer on said sleeve returns, after developing action at the developing area, into said container, said sealing means being effective to allow the developer to return into said container while preventing the magnetic particles from leaking out thereof; and means for rotating said magnet roller at a speed higher than the rotation speed of said sleeve and in the same direction as the direction of sleeve rotation to apply a conveying force to the magnetic particles in the direction opposite to the direction of both sleeve rotation and movement of the non-magnetic developer;

whereby substantially only non-magnetic developer is withdrawn from said container for development.

* * * * *